US011484466B2

(12) United States Patent
Kavanagh et al.

(10) Patent No.: US 11,484,466 B2
(45) **Date of Patent: *Nov. 1, 2022**

(54) DEVICE FOR PRODUCING CONTINUOUS NEGATIVE ABDOMINAL PRESSURE

(71) Applicant: THE HOSPITAL FOR SICK CHILDREN, Toronto (CA)

(72) Inventors: Brian Patrick Kavanagh, Toronto (CA); Doreen Engelberts, Toronto (CA); Takeshi Yoshida, Takarazuka (JP); Thomas Looi, Markham (CA); Peter Alexander Gordon, Toronto (CA); Kevin Ai Xin Jue Luo, Toronto (CA); Rami Saab, Toronto (CA)

(73) Assignee: THE HOSPITAL FOR SICK CHILDREN, Toronto (CA)

( * ) Notice: Subject to any disclaimer, the term of this patent is extended or adjusted under 35 U.S.C. 154(b) by 274 days.

This patent is subject to a terminal disclaimer.

(21) Appl. No.: 16/884,279

(22) Filed: May 27, 2020

(65) Prior Publication Data

US 2020/0281811 A1 Sep. 10, 2020

Related U.S. Application Data

(63) Continuation-in-part of application No. 16/766,017, filed as application No. PCT/CA2018/051478 on Nov. 21, 2018.

(Continued)

(51) Int. Cl.
*A61H 31/02* (2006.01)
*A61H 31/00* (2006.01)

(52) U.S. Cl.
CPC ..... *A61H 31/02* (2013.01); *A61H 31/008* (2013.01); *A61H 2031/025* (2013.01);
(Continued)

(58) Field of Classification Search
CPC ..... A61H 31/02; A61H 31/008; A61H 2201/0161; A61H 2031/025; A61H 2201/5043; A61H 2203/0456
See application file for complete search history.

(56) References Cited

U.S. PATENT DOCUMENTS 4,621,621 A * 11/1986 Marsalis ..... A61H 31/02 137/625.45
8,968,224 B2 * 3/2015 Halperin ..... A61B 5/318 601/41

(Continued)

FOREIGN PATENT DOCUMENTS

WO 8704615 A2 8/1987
WO WO-8704615 A * 8/1987 ..... A61H 31/02

(Continued)

OTHER PUBLICATIONS

Gattinoni L, Marini JJ, Pesenti A, Quintel M, Mancebo J, Brochard L. The "baby lung" became an adult. Intensive care medicine 2016; 42: 663-673.

Briel M, Meade M, Mercat A, Brower RG, Talmor D, Walter SD, Slutsky AS, Pullenayegum E, Zhou Q, Cook D, Brochard L, Richard JC, Lamontagne F, Bhatnagar N, Stewart TE, Guyatt G. Higher vs lower positive end-expiratory pressure in patients with acute lung injury and acute respiratory distress syndrome: systematic review and metaanalysis. Jama 2010; 303: 865-873.

(Continued)

*Primary Examiner* — Samchuan C Yao
*Assistant Examiner* — Tyler A Raubenstraw
(74) *Attorney, Agent, or Firm* — Hill & Schumacher

(57) ABSTRACT

This disclosure relates to device for providing continuous negative abdominal pressure (CNAP) which selectively recruits (inflates) the dorsal (spinal region) collapsed areas of the lung, while enabling the patient to remain in the supine (usual) position. The CNAP device includes a rigid frame configured to have a shape and size to envelop a patient's lower chest and abdominal area while in a supine position with the frame having opposed edges which sit on a surface on which the supine patient is resting. A pressure sensor is mounted to the frame for measuring a pressure inside the chamber and is connected to a display for dis- (Continued)

playing the pressure inside the chamber. An active pressure controller is connected to the pressure sensor, and a vacuum pump is in flow communication with inside the chamber and connected to the active pressure controller. The device includes a top up pump in flow communication with inside the chamber and connected to the active pressure controller which is programmed to instruct the vacuum pump to provide negative pressure in the chamber to start decompressing the chamber, and to instruct the top up pump to maintain the negative pressure in the chamber.

4 Claims, 6 Drawing Sheets

Related U.S. Application Data

(60) Provisional application No. 62/589,285, filed on Nov. 21, 2017.

(52) U.S. Cl.
CPC ..... *A61H 2201/0103* (2013.01); *A61H 2201/165* (2013.01); *A61H 2201/5071* (2013.01); *A61H 2203/0456* (2013.01)

(56) References Cited

U.S. PATENT DOCUMENTS

| | | | | |
|---|---|---|---|---|
| 2008/0115786 | A1* | 5/2008 | Sinderby | A61M 16/022 128/204.23 |
| 2010/0319691 | A1* | 12/2010 | Lurie | A61M 16/04 128/205.24 |
| 2011/0313332 | A1* | 12/2011 | Rahman | A61H 31/00 601/41 |
| 2014/0052032 | A1* | 2/2014 | Freeman | A61H 31/007 601/41 |

FOREIGN PATENT DOCUMENTS

| | | | | |
|---|---|---|---|---|
| WO | 2005056076 | A2 | 6/2005 | |
| WO | WO-2005056076 | A2 * | 6/2005 | A61H 31/02 |

OTHER PUBLICATIONS

Rimensberger PC, Cox PN, Frndova H, Bryan AC. The open lung during small tidal volume ventilation: concepts of recruitment and "optimal" positive end-expiratory pressure. Critical care medicine 1999; 27: 1946-1952.

Hedenstiema G, Tokies L, Lundquist H, Andersson T, Strandberg A, Brismar B. Phrenic nerve stimulation during halothane anesthesia. Effects of atelectasis. Anesthesiology 1994; 80: 751-760.

Sugerman HJ, Felton IW, 3rd, Sismanis A, Saggi BH, Doty JM, Blocher C, Marmarou A, Makhoul RG. Continuous negative abdominal pressure device to treat pseudotumor cerebri. International journal of obesity and related metabolic disorders : journal of the International Association for the Study of Obesity 2001; 25: 486-490.

Valenza F, Bottino N, Canavesi K, Lissoni A, Alongi S, Losappio S, Carlesso E, Gattinoni L. Intra-abdominal pressure may be decreased non-invasively by continuous negative extra-abdominal pressure (NEXAP). Intensive care medicine 2003; 29: 2063-2067.

Chierichetti M, Engelberts D, El-Khuffash A, Babyn P, Post M, Kavanagh BP. Continuous negative abdominal distension augments recruitment of atelectatic lung. Critical care medicine 2012; 40:1864-1872.

Valenza F, Irace M, Guglielmi M, Gatti S, Bottino N, Tedesco C, Maffioletti M, Maccagni P, Fossali T, Aletti G, Gattinoni L. Effects of continuous negative extra-abdominal pressure on cardiorespiratory function during abdominal hypertension: an experimental study. Intensive care medicine 2005; 31: 105-111.

Agostoni E, D'Angelo E, Bonanni MV. The effect of the abdomen on the vertical gradient of pleural surface pressure. Respiration physiology 1970; 8: 332-346.

Bellani G, Laffey JG, Pham T, Fan E, Brochard L, Esteban A, Gattinoni L, van Haren F, Larsson A, McAuley DF, Ranieri M, Rubenfeld G, Thompson BT, Wrigge H, Slutsky AS, Pesenti A. Epidemiology, Patterns of Care, and Mortality for Patients With Acute Respiratory Distress Syndrome in Intensive Care Units in 50 Countries. Jama 2016; 315: 788-800.

International Search Report of the parent PCT application PCT/CA2018/051478 dated Apr. 15, 2019.

* cited by examiner

DEVICE FOR PRODUCING CONTINUOUS NEGATIVE ABDOMINAL PRESSURE

FIELD OF THE DISCLOSURE

This disclosure relates to device for providing continuous negative abdominal pressure (CNAP) which selectively recruits (inflates) the dorsal (dependent region) collapsed areas of the lung, while enabling the patient to remain in the supine (usual) position.

BACKGROUND

Acute Respiratory Distress syndrome (ARDS) is a serious pulmonary disease affecting adults and children. It has a high mortality and there is no specific therapy. Outcome (mortality greater than 40% in severe cases) is unchanged in the last 20 years.

Lung Injury occurs mostly in ventilated, non-dependent lung regions, termed the 'baby' lung (1). Recruitment of dependent atelectasis (collapsed areas of lung) involves elevating airway pressure with high levels of Positive End-Expiratory Pressure (PEEP) or high frequency ventilation, and increasing the amount of the baby lung reduces its susceptibility to injury from inspiratory stretch. But clinical studies of these techniques have resulted in marginal benefit (2), possibly because before recruiting (inflating) atelectatic lung, increased airway pressure first overinflates (and potentially injures) already aerated regions (3).

Mechanical ventilation is the mainstay of management, and this assists the patient by increasing oxygenation and removal of carbon dioxide. Despite optimizing tidal volume, driving pressure and PEEP, patients with ARDS develop large areas of atelectasis and poor oxygenation. There are few additional ventilator approaches that have proven to be useful in preventing this type of injury.

A major aim of ventilator support is recruitment of atelectatic lung, but while this is supported by excellent rationale and laboratory data, the conventional clinical approaches have not been associated with a significant improvement in patient outcome. Most atelectasis in ARDS occurs in the dorsal (along the spine, lower-most) lung regions, and these are near the diaphragm (which separates the chest from the abdomen).

The main ways to recruit (inflate) lung are to increase the airway distending pressure (increase the force in which air is pushed into the lungs), but this over-expands and damages the already-inflated lung regions or, to turn the patient into the prone position. However, clinicians are reluctant to utilize this approach, (despite evidence that it may increase survival), because of the concerns that most patients have many monitoring devices and indwelling catheters that may become dislodged while turning the patient prone.

Abdominal pressure is a key factor that increases the propensity to dependent atelectasis (4). Negative pressure applied outside the abdomen can lower the intra-abdominal pressure in patients (5, 6), and could potentially decrease dorsal atelectasis by caudal (toward the feet) shift of the diaphragm. The present inventors (7) and others (6, 8) have previously attempted this, but its impact may have been limited by ineffective transmission of external negative pressure (6, 8) or the use of a rodent model (7).

Providing a device that can provide continuous negative abdominal pressure (CNAP) that aims to selectively recruit (inflate) the dorsal (spinal region) collapsed areas of the lung, while enabling the patient to remain in the supine (usual) position would be very advantageous in the treatment of ARDS.

SUMMARY

Provided is a continuous negative abdominal pressure (CNAP) device which aims to selectively recruit (inflate) the dorsal (spinal region) collapsed areas of the lung, while enabling the patient to remain in the supine (usual) position.

There is provided a device for providing continuous negative abdominal pressure, comprising a rigid frame configured to have a shape and size to envelop a patient's lower chest and abdominal area while in a supine position, the frame having opposed edges which sit on a surface on which the supine patient is resting when in use. The device includes a series of panels mounted in the frame such that the series of panels extend around the patient's lower chest and abdominal area. A flexible sheet is wrapped around the outside of the panels and being long enough to extend up to the patient's upper chest and down to the patient's thighs and wide enough to envelop the supine patients lower chest and abdominal area. Sealing members are included to seal the flexible sheet around the patient's lower rib cage and pelvis, wherein a chamber is formed between the patient and the device when the patient is enveloped by the device. A pressure sensor mounted to the frame for measuring a pressure inside the chamber, the pressure sensor connected to a display for displaying the pressure inside the chamber during use. An active pressure controller is connected to the pressure sensor and a vacuum pump that is in flow communication with inside the chamber. The device includes a top up pump in flow communication with inside the chamber and connected to the active pressure controller. The active pressure controller is configured to instruct the vacuum pump to provide negative pressure in the chamber to start decompressing the chamber and is configured to instruct the top up pump to maintain the negative pressure in the chamber.

The active pressure controller is programmed to generate negative pressure of between about −5 to about −10 cm $H_2O$ inside the chamber.

The panels may be flat panels, and in this case the rigid frame is configured such that when the flat panels are mounted to the frame the flat panels are at a preselected angle with respect to each other.

Alternatively, the frame may comprise of two arcuate shaped frame sections configured and fitted together to allow for relative sliding motion of each arcuate shaped frame section with respect to the other for enabling adjustment of the overall size of the device, and thus the panels are arcuate shaped panels matching an arcuate shape of the frame sections.

A further understanding of the functional and advantageous aspects of the present disclosure can be realized by reference to the following detailed description and drawings.

BRIEF DESCRIPTION OF DRAWINGS

This disclosure will be more fully understood from the following detailed description thereof taken in connection with the accompanying drawings, which form part of this application, and in which.

DETAILED DESCRIPTION

Figure 1:
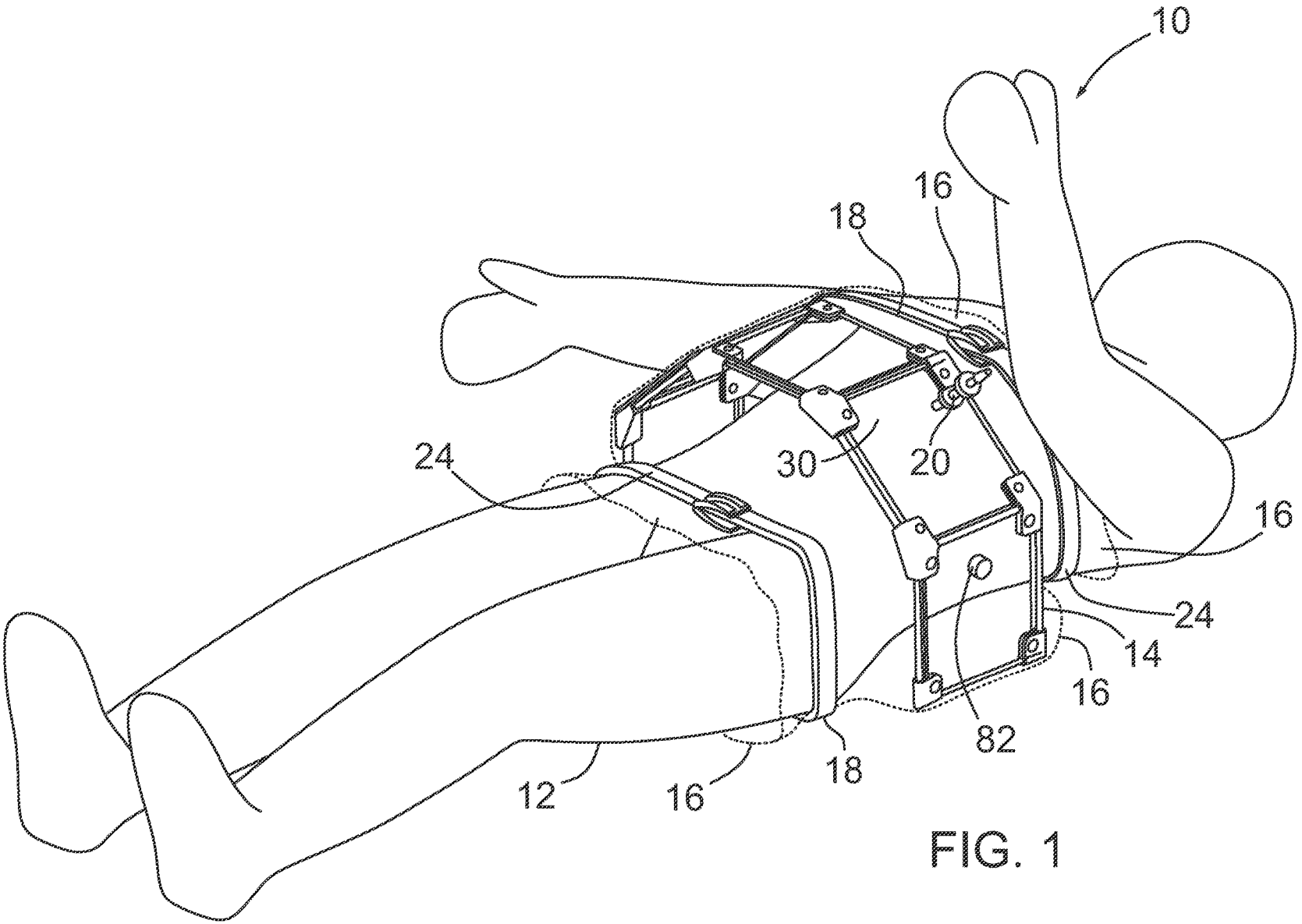
FIG. 1 is a perspective view of a patient positioned within a device for providing continuous negative abdominal pressure constructed in accordance with the present disclosure.

The devices described herein are directed, in general, to patient compliance measuring and recording devices for measuring and recording patient compliance with using a wearable treatment for a medical condition. Although embodiments of the present invention are disclosed herein, the disclosed embodiments are merely exemplary and it should be understood that the invention relates to many alternative forms, including different shapes and sizes. Furthermore, the Figures are not drawn to scale and some features may be exaggerated or minimized to show details of particular features while related elements may have been eliminated to prevent obscuring novel aspects. Therefore, specific structural and functional details disclosed herein are not to be interpreted as limiting but merely as a basis for the claims and as a representative basis for enabling someone skilled in the art to employ the present invention in a variety of manners.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

As used herein, the terms "about" and "approximately", when used in conjunction with ranges of dimensions, compositions of mixtures or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

In an embodiment the device for providing continuous negative abdominal pressure comprises a rigid frame configured to have a shape and size to envelop a patient's lower chest and abdominal area while in a supine position. The frame has opposed edges which sit on a surface on which the supine patient is resting when in use. A series of panels are mounted in the frame such that the series of panels extend around the patient's lower chest and abdominal area. A flexible sheet is wrapped around the outside of the panels and is long enough to extend up to the patient's upper chest and down to the patient's thighs and wide enough to envelop the supine patient's lower chest and abdominal area. The CNAP device includes sealing members to seal the flexible sheet around the patient's lower chest and pelvis, wherein a chamber is formed between the patient and the device when the patient is enveloped by the device. One of the series of panels includes an air inlet coupling attachable to a suction source which is configured to generate negative pressure of between about −5 to about −10 cm $H_2O$ inside the chamber.

In an embodiment the device includes a pressure sensor mounted to the frame for measuring a pressure inside the chamber and the pressure sensor is connected to a display for displaying the pressure inside the chamber during use.

In an embodiment the panels may be flat panels, and in this embodiment the rigid frame is configured and constructed such that when the flat panels are mounted to the frame the flat panels are at a preselected angle with respect to each other.

In an embodiment the frame comprises two arcuate shaped frame sections configured and fitted together to allow for relative sliding motion of each arcuate shaped frame section with respect to the other for enabling adjustment of the overall size of the device, and thus the panels are arcuate shaped panels matching an arcuate shape of the frame sections.

Figure 2:
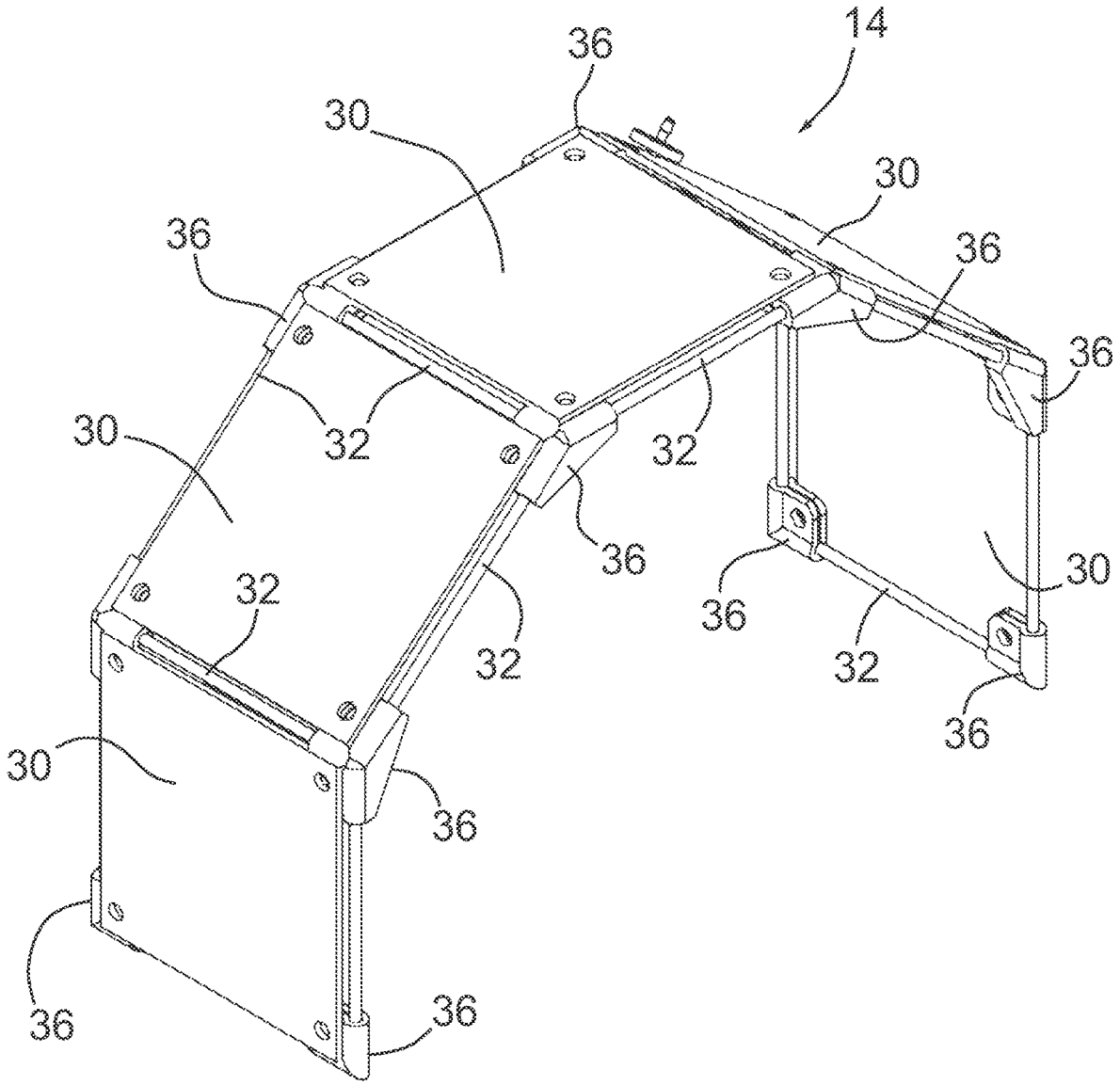
FIG. 2 is an enlarged view of part of the device of FIG. 1.

Referring to FIGS. 1 and 2, a patient encased in a device for providing continuous negative abdominal pressure (CNAP) constructed in accordance with the present disclosure is shown generally at 10. The patient 12 is shown in the preferred supine position with a continuous negative abdominal pressure device 14 enveloping his lower chest and abdominal area.

Continuous negative abdominal pressure device 14 includes a series of panels 30 with each panel 30 attached to a neighboring panel 30 using braces 36. Each panel has a rod 32 extending along each outer edge of the panel. Each brace 36 has three channels to receive the ends of three rods 32 to allow each panel 30 to be coupled to its neighboring panel 30. Each brace 36 has two channels at about 45 degrees so that when panels 30 are connected together they fit around the chest and abdomen of the patient with the outer ends of the two end panels 30 resting on either side of the patient on the surface/bed on which the patient is lying.

As shown in FIG. 1, one of the panels 30 located above the patient's torso includes a barbed pipe connector 20. Connector 20 is connected to the wall vacuum line to create negative pressure inside the chamber formed between the patient and CNAP 14. This negative pressure is transmitted through the abdomen and pulls the diaphragm towards the direction of the patient's feet when the device 14 is secured around the patient 12.

A transparent flexible sheet 16 is wrapped around the outside of the panels 30 and is long enough to extend up to the patient's upper chest and down to the patient's thighs as well as being wide enough to be fully wrapped around the patient. The barb pipe connector 20 is pushed through the plastic sheet 16, a hose connected to the negative wall pressure is attached to the barb pipe connector 20. Once belt 24 is tightened around the patient's lower ribcage (level with xyphoid) on the outside of the sheet 16 and is tight enough to form a seal to prevent leakage of air from the chamber formed by device 14. Similarly a second belt 24 is tightened around the patient's pelvis (level with hip bones) to seal sheet 16 around the patient's pelvis to prevent leakage from the chamber. A foam strip 18 is located under the belt 24 for patient comfort.

It will be appreciated by those skilled in the art that continuous negative abdominal pressure device 14 may be built for different sized patients, whether they are young babies or fully-grown adults, the device 14 may be built to accommodate any age or sized patient.

In operation, once the continuous negative abdominal pressure device 14 is secured around the patient 12 as shown in FIG. 1, tubing is connected to valve 20 and wall suction is applied to generate negative pressure of −5 to −10 cm $H_2O$ inside the CNAP device chamber. This negative pressure is transmitted through the abdomen and causes the dorsal portion of the diaphragm to be pulled inferiorly which in turns draws air into the dorsal atelectatic regions of the lung without overstretching the already open ventral regions of the lung. This will increase the patient's oxygenation without increasing the airway pressure.

A negative pressure sensor 82 and associated display screen (not shown) may be mounted on one of the panels 30 and configured to measure the negative pressure inside the device and display it on the screen.

In studies using 12 healthy adults, the present CNAP device 14 of FIGS. 1 and 2 was secured onto the abdomen of the volunteers and −5 cm $H_2O$ of negative pressure was applied for 30 minutes. Patient comfort, heart rate, respiratory rate, pulse oximetry and blood pressure were monitored throughout the 30 minutes. The results showed that the present CNAP had no significant effect on blood pressure, pulse oximetry, or on heart or respiratory rate. The volunteers reported no significant level of discomfort.

Figure 3:
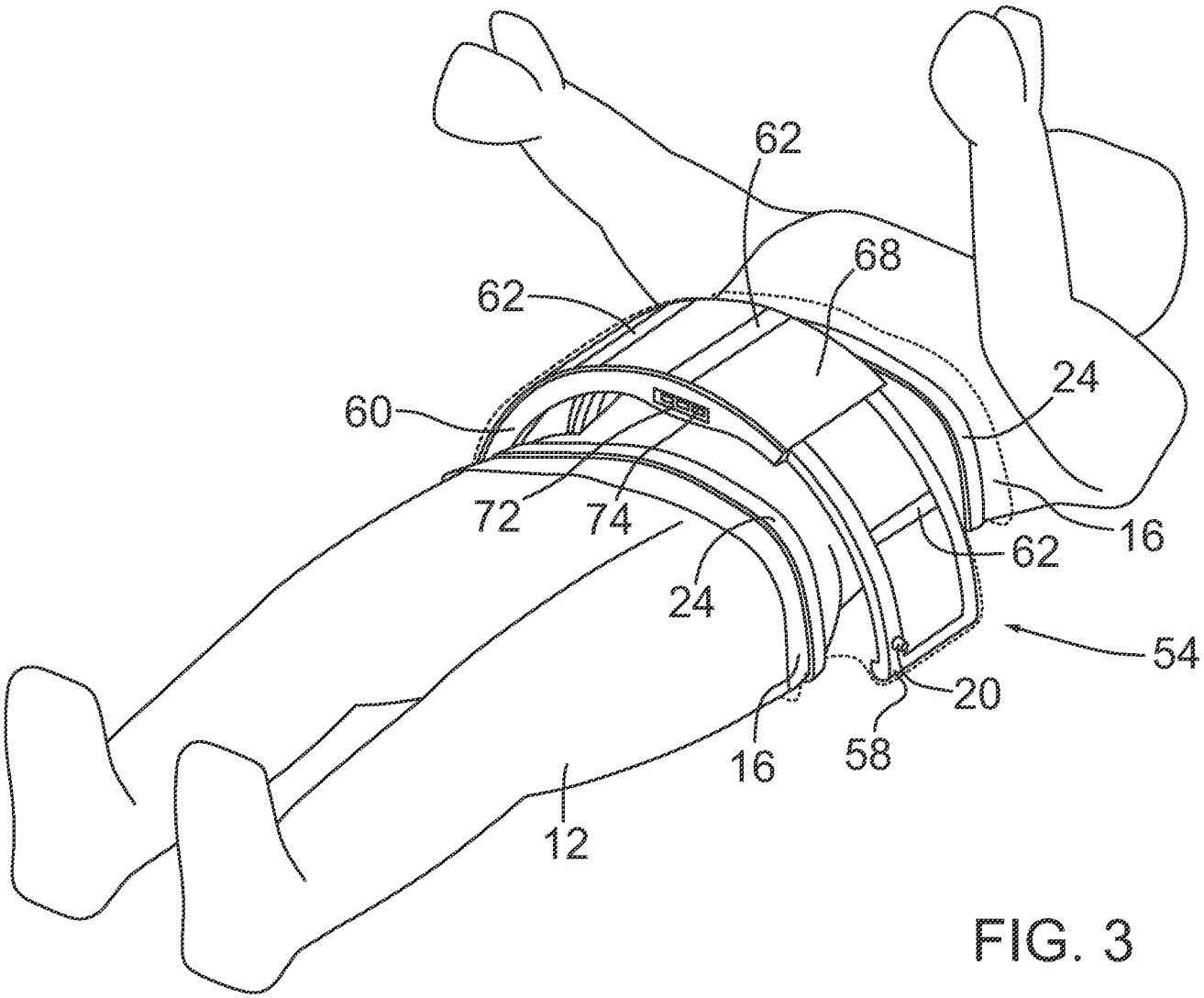
FIG. 3 is a perspective view of a patient positioned within a second embodiment of a device for providing continuous negative abdominal pressure constructed in accordance with the present disclosure.
Figure 4:
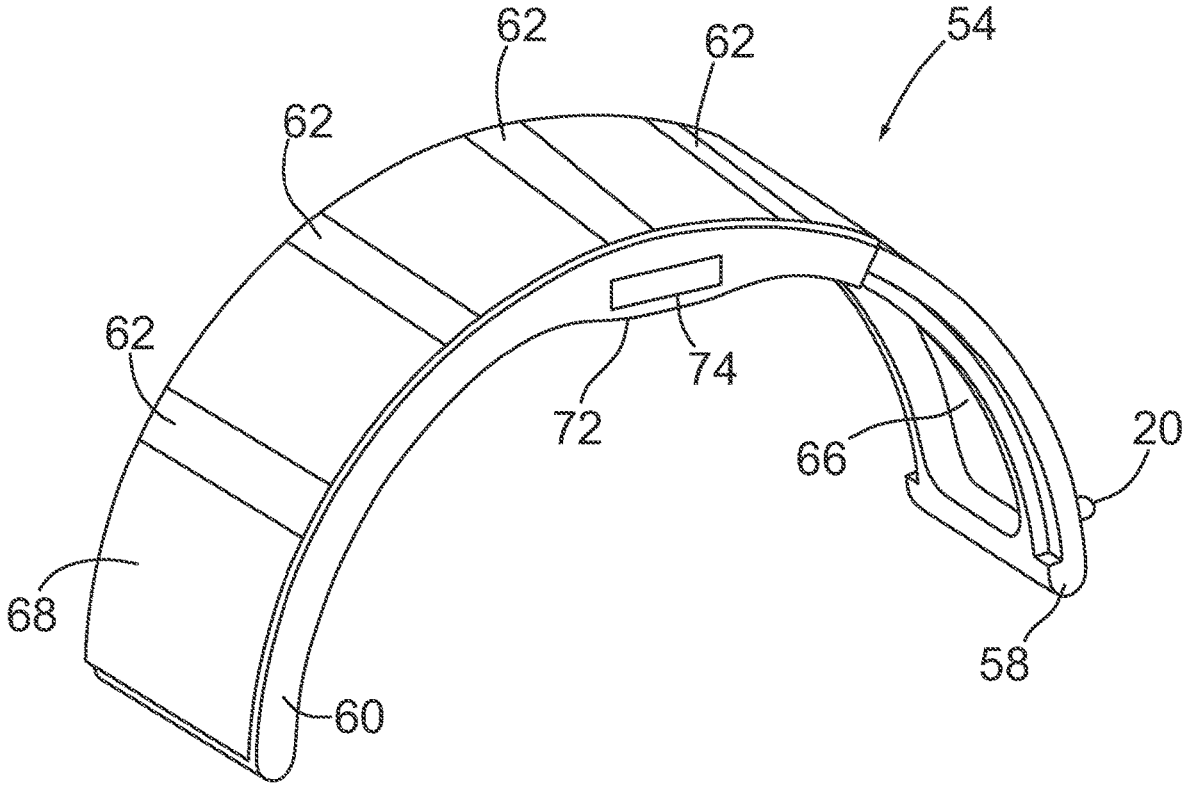
FIG. 4 is an enlarged view of part of the device of FIG. 3.

Referring to FIGS. 3 and 4, the patient 12 is shown encased in another embodiment of a device for providing continuous negative abdominal pressure (CNAP) constructed in accordance with the present disclosure shown generally at 50. The patient 12 is shown in the preferred supine position with a continuous negative abdominal pressure device 54 enveloping his lower chest and abdominal area.

Continuous negative abdominal pressure device 54 includes two concentric 120 degree arcuate shaped arches 58 and 60 which comprise the frame of the device 54. The arches 58 and 60 are fitted together to allow for relative sliding motion, enabling adjustment of the overall size of the structure 54. Aluminum braces 62 are used to increase the rigidity of arches 58 and 60. Two transparent panels 66 and 68 are placed over the arches 58 and 60. A negative pressure sensor module 72 is embedded into arch 60 and the negative pressure inside the device is displayed on a screen 74.

As shown in FIG. 3, arch 58 includes a built-in barbed pipe connector 20 similar to that shown in FIG. 1. Pipe connector 20 is connected to the wall vacuum line to create negative pressure inside the chamber. This negative pressure is transmitted through the abdomen and pulls the diaphragm towards the direction of the feet when the device 14 is secured around the patient 12.

Transparent flexible sheet 16 in FIG. 1 is wrapped around the outside of the device 54 and is long or wide enough to extend up to the patient's upper chest and down to the patient's thighs. One belt 24 is tightened around the patient's lower ribcage (level with xyphoid) upper chest on the outside of the sheet and is tight enough to form a seal to prevent leakage of air from the chamber formed by device 54. Similarly a second belt 24 is tightened around the patient's pelvis (level with hip bones) to seal the sheet around the patient's pelvis to prevent leakage from the chamber.

It will be appreciated by those skilled in the art that continuous negative abdominal pressure device 54 may be built for different sized patients, whether they are young babies or fully-grown adults, the device 54 may be built to accommodate any age or sized patient.

In operation, the CNAP device 54 operates essentially the same as CNAP device 14, so that once the continuous negative abdominal pressure device 54 is secured around the patient 12 as shown in FIG. 1, an air tubing hose is connected to connector 20 and wall suction is applied to generate negative pressure of −5 to −10 cm $H_2O$ inside the CNAP device chamber. This negative pressure is transmitted through the abdomen. It causes the dorsal portion of the diaphragm to be pulled inferiorly which in turns draws air into the dorsal atelectatic regions of the lung without overstretching the already open ventral regions of the lung. This will increase the patient's oxygenation without increasing the airway pressure.

Figure 5:
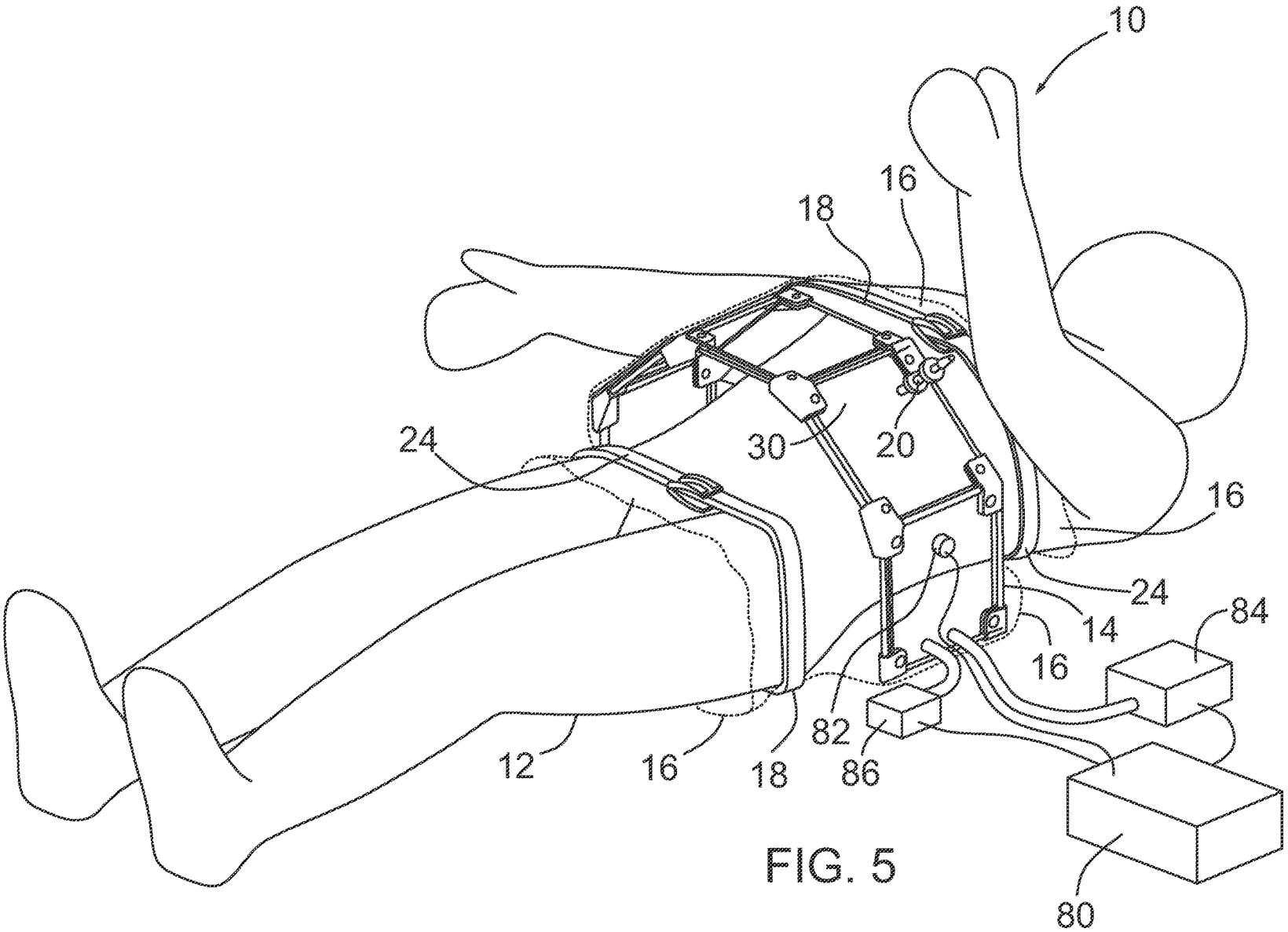
FIG. 5 shows the CNAP device of FIGS. 1 to 4 integrated with a top up pump, a vacuum pump, a pressure sensor and an active pressure controller.
Figure 6:
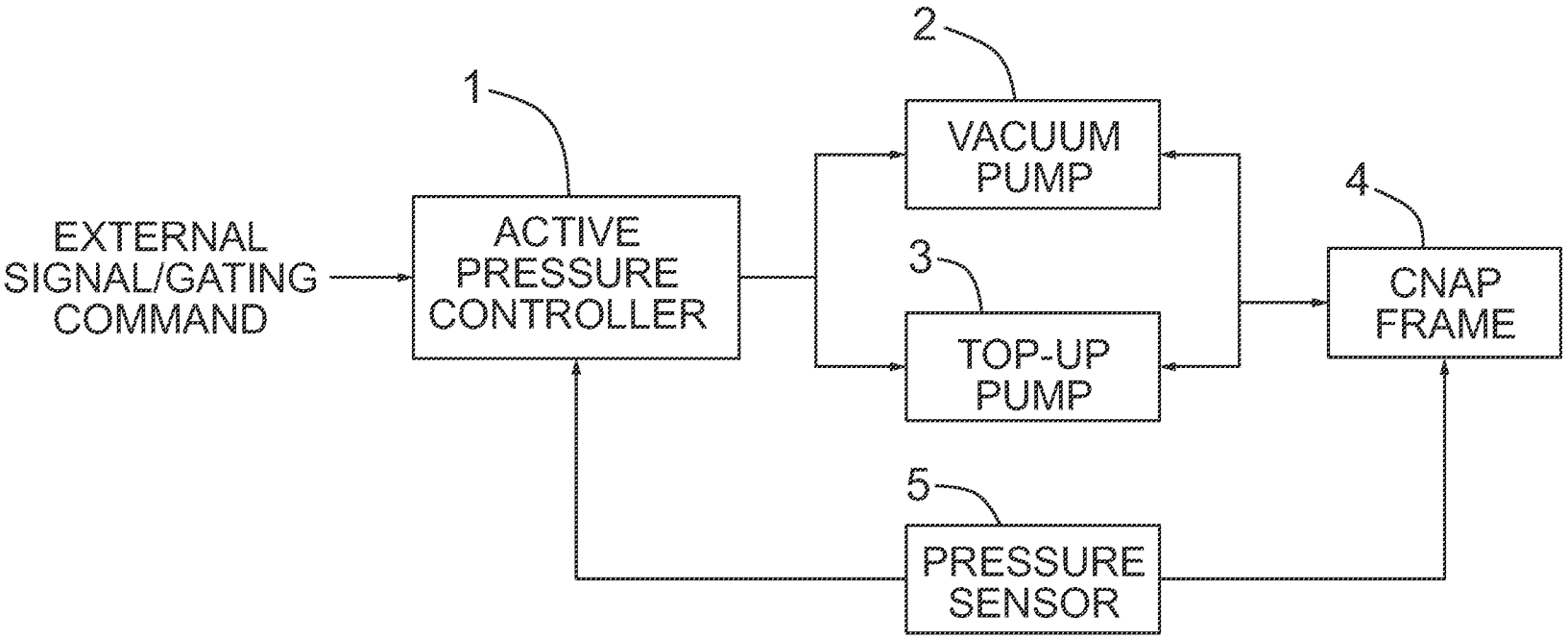
FIG. 6 is a system level diagram of the CNAP device integrated with the top up pump, a vacuum pump, a pressure sensor and active pressure controller as shown in FIG. 5.

Referring to FIGS. 5 and 6, the CNAP device 10 is integrated with a control system which includes an active pressure controller (APC) 80 which measures the internal pressure of the CNAP frame via pressure sensor 82, and controls the pressure by activating either vacuum pump 84 or top up pump 86. The APC 80 can receive signals and or gating commands from an external device such as a ventilator to synchronous the pressure commands. The vacuum pump 84 provides the negative pressure to start de-compressing the CNAP frame 10 while the top-up pump 86 is used to maintain the negative pressure. The CNAP frame 10 is the rigid structure on the patient as shown in FIG. 1. The pressure sensor 82 measures the internal pressure of the CNAP frame 10 when it is engaged around the patient with the seal established by sheet 16 being sealed by belts 24.

In summary, an embodiment of a device is disclosed for providing continuous negative abdominal pressure comprises a rigid frame configured to have a shape and size to envelop a patient's lower chest and abdominal area while in a supine position. The frame has opposed edges which sit on a surface on which the supine patient is resting when in use. A series of panels are mounted in the frame such that the series of panels extend around the patient's lower chest and abdominal area. A flexible sheet is wrapped around the outside of the panels and is long enough to extend up to the patient's upper chest and down to the patient's thighs and wide enough to envelop the supine patient's lower chest and abdominal area. The CNAP device includes sealing members to seal the flexible sheet around the patient's lower ribcage (xyphoid level) and pelvis (hipbone level), wherein a chamber is formed between the patient and the device when the patient is enveloped by the device. One of the series of panels includes an air inlet coupling attachable to a suction source which is configured to generate negative pressure of between about −5 to about −10 cm $H_2O$ inside the chamber.

In an embodiment the device may include a pressure sensor mounted to the frame for measuring a pressure inside the chamber and the pressure sensor is connected to a display for displaying the pressure inside the chamber during use.

In an embodiment the panels are flat panels, and the rigid frame is configured such that when the flat panels are mounted to the frame the flat panels are at a preselected angle with respect to each other.

In an alternative embodiment the frame is comprised of two arcuate shaped frame sections configured and fitted together to allow for relative sliding motion of each arcuate shaped frame section with respect to the other for enabling adjustment of the overall size of the device, and thus the panels are arcuate shaped panels matching an arcuate shape of the frame sections.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

REFERENCES

1. Gattinoni L, Marini J J, Pesenti A, Quintel M, Mancebo J, Brochard L. The "baby lung" became an adult. *Intensive care medicine* 2016; 42: 663-673.
2. Briel M, Meade M, Mercat A, Brower R G, Talmor D, Walter S D, Slutsky A S, Pullenayegum E, Zhou Q, Cook D, Brochard L, Richard J C, Lamontagne F, Bhatnagar N, Stewart T E, Guyatt G. Higher vs lower positive end-expiratory pressure in patients with acute lung injury and acute respiratory distress syndrome: systematic review and meta-analysis. *Jama* 2010; 303: 865-873.
3. Rimensberger P C, Cox P N, Frndova H, Bryan A C. The open lung during small tidal volume ventilation: concepts of recruitment and "optimal" positive end-expiratory pressure. *Critical care medicine* 1999; 27: 1946-1952.
4. Hedenstierna G, Tokics L, Lundquist H, Andersson T, Strandberg A, Brismar B. Phrenic nerve stimulation during halothane anesthesia. Effects of atelectasis. *Anesthesiology* 1994; 80: 751-760.
5. Sugerman H J, Felton I W, 3rd, Sismanis A, Saggi B H, Doty J M, Blocher C, Marmarou A, Makhoul R G. Continuous negative abdominal pressure device to treat pseudotumor cerebri. *International journal of obesity and related metabolic disorders: journal of the International Association for the Study of Obesity* 2001; 25: 486-490.
6. Valenza F, Bottino N, Canavesi K, Lissoni A, Alongi S, Losappio S, Carlesso E, Gattinoni L. Intra-abdominal pressure may be decreased non-invasively by continuous negative extra-abdominal pressure (NEXAP). *Intensive care medicine* 2003; 29: 2063-2067.
7. Chierichetti M, Engelberts D, El-Khuffash A, Babyn P, Post M, Kavanagh B P. Continuous negative abdominal distension augments recruitment of atelectatic lung. *Critical care medicine* 2012; 40: 1864-1872.
8. Valenza F, Irace M, Guglielmi M, Gatti S, Bottino N, Tedesco C, Maffioletti M, Maccagni P, Fossali T, Aletti G, Gattinoni L. Effects of continuous negative extra-abdominal pressure on cardiorespiratory function during abdominal hypertension: an experimental study. *Intensive care medicine* 2005; 31: 105-111.
9. Agostoni E, D'Angelo E, Bonanni M V. The effect of the abdomen on the vertical gradient of pleural surface pressure. *Respiration physiology* 1970; 8: 332-346.
10. Bellani G, Laffey J G, Pham T, Fan E, Brochard L, Esteban A, Gattinoni L, van Haren F, Larsson A, McAuley D F, Ranieri M, Rubenfeld G, Thompson B T, Wrigge H, Slutsky A S, Pesenti A. Epidemiology, Patterns of Care, and Mortality for Patients With Acute Respiratory Distress Syndrome in Intensive Care Units in 50 Countries. *Jama* 2016; 315: 788-800.

Therefore what is claimed is:

1. A device for providing continuous negative abdominal pressure, comprising:

a rigid frame configured to have a shape and size to envelop a patient's lower chest and abdominal area while in a supine position, the frame having opposed edges which sit on a surface on which the supine patient is resting when in use, wherein said rigid frame comprises two arcuate shaped frame sections configured and fitted together to allow for relative sliding motion of each arcuate shaped frame section with respect to the other for enabling adjustment of the overall size of the device, each arcuate shaped frame section having an arcuate shaped panel attached thereto and having an arcuate shape matching an arcuate shape of the frame section;

a flexible sheet wrapped around the outside of the panels and being long enough to extend up to the patient's upper chest and down to the patient's thighs and wide enough to envelop the supine patient's lower chest and abdominal area;

sealing members to seal said flexible sheet around the patient's lower rib cage and pelvis, wherein a chamber is formed between the patient and said device when the patient is enveloped by the device;

a pressure sensor mounted to said frame for measuring a pressure inside said chamber, said pressure sensor connected to a display for displaying the pressure inside said chamber during use; and an active pressure controller connected to said pressure sensor, and further comprising a first vacuum pump in flow communication with inside the chamber and connected to said active pressure controller, and including a second vacuum pump in flow communication with inside the chamber and connected to said active pressure controller, wherein said active pressure controller is configured to instruct the vacuum pump to provide negative pressure in the chamber to start decompressing the chamber, and wherein said active pressure controller is configured to instruct the second vacuum pump to maintain the negative pressure in the chamber.

2. The device according to claim 1, wherein said active pressure controller is configured to generate a negative pressure of between about −5 to about −10 cm $H_2O$ inside the chamber.

3. The device according to claim 1, wherein said sealing members are flexible belts.

4. The device according to claim 2, wherein said sealing members are flexible belts.

* * * * *